US010640183B2

(12) United States Patent
Kim

(10) Patent No.: US 10,640,183 B2
(45) Date of Patent: May 5, 2020

(54) SHIP HAVING ANTI-SINKING AND ANTI-CAPSIZE DEVICE FOR EMERGENCY

(71) Applicant: Chongchul Kim, Uijeongbu-si (KR)

(72) Inventor: Chongchul Kim, Uijeongbu-si (KR)

( * ) Notice: Subject to any disclaimer, the term of this patent is extended or adjusted under 35 U.S.C. 154(b) by 0 days.

(21) Appl. No.: 16/092,024

(22) PCT Filed: Apr. 28, 2017

(86) PCT No.: PCT/KR2017/004532

§ 371 (c)(1),
(2) Date: Oct. 8, 2018

(87) PCT Pub. No.: WO2017/191938

PCT Pub. Date: Nov. 9, 2017

(65) Prior Publication Data

US 2019/0112014 A1 Apr. 18, 2019

(30) Foreign Application Priority Data

May 4, 2016 (KR) ..... 10-2016-0055708

(51) Int. Cl.

| | |
|---|---|
| ***B63B 43/14*** | (2006.01) |
| ***B63B 19/00*** | (2006.01) |
| ***B63B 27/00*** | (2006.01) |
| ***B63B 39/06*** | (2006.01) |
| ***B63B 43/12*** | (2006.01) |

(Continued)

(52) U.S. Cl.

CPC ..... *B63B 43/14* (2013.01); *B63B 19/00* (2013.01); *B63B 27/00* (2013.01); *B63B 39/06* (2013.01); *B63B 43/12* (2013.01); *B63H 16/04* (2013.01); *B63B 17/04* (2013.01); *B63B 2043/126* (2013.01); *B63B 2043/145* (2013.01)

(58) Field of Classification Search

CPC ..... B63B 2043/145; B63B 2043/042; B63B 39/06; B63B 21/26; B63B 43/02

See application file for complete search history.

(56) References Cited

U.S. PATENT DOCUMENTS 3,693,569 A * 9/1972 Chauvin ..... B63B 43/20 114/382
4,254,730 A * 3/1981 Crenshaw ..... B63B 21/50 114/294

(Continued)

FOREIGN PATENT DOCUMENTS

JP 2010-128503 A 6/2010
JP 2015-164834 * 9/2015 ..... B63B 43/14

(Continued)

*Primary Examiner* — Andrew Polay

(74) *Attorney, Agent, or Firm* — Korus Patent, LLC; Seong Il Jeong

(57) ABSTRACT

According to the present invention, there is provided a ship having an anti-sinking and anti-capsize device for emergency, which, in an emergency situation that may be caused by load or loss of buoyancy attributable to flooding, can continuously maintain the state of floating on the water by generating buoyancy inside and below a lower hull, and can prevent the ship from being tilted to one side or being completely capsized by maintaining the balance of the ship, thereby preventing a deadly accident that may occur in an emergency, such as a ship sinking accident, and also facilitating rescue operations.

5 Claims, 13 Drawing Sheets

(51) Int. Cl.
*B63H 16/04* (2006.01)
*B63B 17/04* (2006.01)

(56) References Cited

U.S. PATENT DOCUMENTS

| | | | | |
|---|---|---|---|---|
| 6,802,274 | B2 * | 10/2004 | Mears | B63B 43/14 114/123 |
| 9,688,359 | B2 * | 6/2017 | de Poorter | B63B 21/26 |
| 10,300,754 | B2 * | 5/2019 | Miller | B60F 3/0038 |
| 10,323,376 | B1 * | 6/2019 | Nickelson | E02B 15/106 |
| 2011/0107952 | A1 * | 5/2011 | Nicholson, IV | B63B 21/26 114/230.13 |
| 2017/0283017 | A1 * | 10/2017 | Hogshead | B63B 43/14 |

FOREIGN PATENT DOCUMENTS

| | | | |
|---|---|---|---|
| JP | 2015-164834 | A | 9/2015 |
| KR | 10-0980562 | B1 | 9/2010 |
| KR | 10-2011-0031402 | A | 3/2011 |
| KR | 10-1122771 | B1 | 3/2012 |
| KR | 10-2012-0081431 | A | 7/2012 |
| KR | 10-2014-0062986 | A | 5/2014 |
| WO | 2010/143085 | A2 | 12/2010 |

* cited by examiner

SHIP HAVING ANTI-SINKING AND ANTI-CAPSIZE DEVICE FOR EMERGENCY

TECHNICAL FIELD

The present invention relates to a ship having an anti-sinking and anti-capsize device for emergency, and more specifically to a ship having an anti-sinking and anti-capsize device for emergency, which, in an emergency situation that may be caused by load or loss of buoyancy attributable to flooding, can continuously maintain the state of floating on the water by generating buoyancy inside and below a lower hull, and can prevent the ship from being tilted to one side or being completely capsized by maintaining the balance of the ship, thereby preventing a deadly accident that may occur in an emergency, such as a ship sinking accident, and also facilitating rescue operations.

BACKGROUND ART

Generally, ships are designed and furnished such that an internal space is partitioned into a machine room, a pump room, cabins, and a warehouse inside a hull according to various purposes. Such ships must be prepared for sinking attributable to external influences. In particular, ships corresponding to large-sized passenger vessels that are boarded by many people are equipped with small lifeboats, safety gears, etc.

More specifically, such a large-sized passenger vessel is a large-sized cruise vessel, and is mainly operated in a large river or sea. A large-sized passenger vessel is operated in the state in which it has been furnished with not only cabins for passengers but also many public areas, such as a restaurant, a swimming pool, a gymnasium, and a social intercourse space.

In particular, a cabin of a passenger vessel is furnished with a bed, a simple wardrobe, and home appliances, such as a TV set, and provides a space for enjoying stay without causing damage to other people. Cabins are disposed on the left and right sides of a hull and a deck in layers, are divided according to their class in a cabin part, and provide accommodations where passengers can stay.

A passenger vessel that travels along a predetermined path in a river or sea may experience an unexpected accident, such as a collision or stranding, due to an engine failure or severe weather conditions. In the case of accidental sinking of the passenger vessel attributable to a failure to cope with such an accident, when the seawater is flooded into one hull within a short period of time, a problem may arise in that the vessel sinks due to the occurrence of an unbalanced flooding phenomenon in spite of a minor accident.

In preparation for the above-described problem, lifeboats are provided so that all passengers on the passenger vessel can escape using the lifeboats at the last moment in an emergency, and a number of life vests are present so that the passengers can individually wear the life vests. However, even when passengers escape the passenger vessel and rush to the river or sea in an emergency situation and equipments for protecting human lives are provided, there are many cases where passengers cannot withstand long and are dead due to hypothermia resulting from the low temperature of the seawater.

Moreover, in the case where the passenger vessel is rapidly tilted in any one direction and then sinks as in a sinking accident having occurred in Korea in April of 2014, hallways as well as cabins are tilted at the same time. Accordingly, a problem arises in that a large-scale deadly accident occurs because it is difficult to move fast for evacuation and escape routes are blocked by flooding water and thus passengers cannot come up on a deck.

In particular, when water rises up on the vessel, the vessel is tilted to one side first, finally there occurs a capsize phenomenon in which a ship is completely inverted by 180 degrees, and then the vessel sinks. Accordingly, there occurs a serious difficulty in rescuing people.

PRIOR ART DOCUMENTS

Patent Documents (Patent Document 1) Korean Patent Application Publication No. 10-2014-0062986
(Patent Document 2) Korean Patent No. 10-0980562
(Patent Document 3) Korean Patent No. 10-1122771

DISCLOSURE

Technical Problem

The present invention has been conceived to overcome the above-described problems of the prior art, and an object of the present invention is to provide a ship having an anti-sinking and anti-capsize device for emergency, which can prevent the ship from being tilted to one side or losing balance and thus being completely capsized even in an emergency situation that may be caused by load or loss of buoyancy attributable to flooding.

Another object of the present invention is to provide a ship having an anti-sinking and anti-capsize device for emergency, which can prevent a ship from sinking and continuously maintain the state of floating on the water even in case of flooding, thereby preventing a deadly accident that may occur in an emergency, such as a ship sinking accident, and also facilitating rescue operations.

Still another object of the present invention is to provide a ship having an anti-sinking and anti-capsize device for emergency, in which a plurality of oars are mounted on posts, formed along the outside of the deck of a lower hull, in horizontal directions, with one side of each of the oars rotatably fastened to a corresponding one of the posts and the other side maintained on another adjacent post in a detachable state, thereby enabling a ship to be moved by pulling the oars or maintaining the balance of a ship in an emergency.

Technical Solution

The present invention is intended to accomplish the above object. According to an aspect of the present invention, there is provided a ship having an anti-sinking and anti-capsize device for emergency, wherein: a buoyancy means configured to be locked to an installation bar installed on the top of the ship and to, when the locking is released in an emergency, be lowered along a vertical movement path formed in the lower hull and prevent the ship from sinking is disposed inside and below a lower hull, and a ship balancing means configured to prevent the ship from capsizing is disposed to extend long below the lower hull; the buoyancy means includes: a first buoyancy member including an upper vacuum cylinder configured to have a flange portion at the upper end thereof so that it is normally locked to the installation bar and is caught on and supported by the upper end of the lower hull in an emergency, and a lower vacuum cylinder famed to have a diameter smaller than that of the upper vacuum cylinder; and a second buoyancy member installed around the lower vacuum cylinder in a folded state, and configured to be inflated and disposed on the bottom surface of the lower hull in an emergency; and the ship balancing means includes: one or more bodies configured to extend while spreading downward in an antenna manner in the state in which the upper end thereof has been supported at the lower end of the lower vacuum cylinder; one or more water inlets formed in the bodies; and a support plate formed at the lower end of the lowest body, and provided with a water outlet having a plug.

According to a preferred feature of the present invention, the ship may further include: first and second rotating members tiltably installed on the installation bar at a predetermined interval, and configured such that the lower ends thereof are bent inward to support the flange portion and form first and second support portions; and springs configured to elastically support the upper portions of the first and second rotating members; and may further include: a body collapsing wire installed such that it is passed through the centers of the upper and lower vacuum cylinders in a vertical direction, a lower end thereof is fastened to the support plate of the lowest body, and an upper end thereof is coupled to a winding pulley provided on the installation bar; and a water outlet opening wire installed on the lower portion of the body collapsing wire to be connected to the plug for the water outlet.

According to a preferred feature of the present invention, the lowest body may be configured such that a part of the circumferential surface thereof is formed in a corrugated cylinder shape; a door configured to be installed in the lower end hole of the vertical movement path may be further included, the door may be installed in such a manner that one end thereof is hinged to the upper end of the lower end hole in the state of being elastically supported and the other end thereof is fitted into a receiving depression formed in the inside of the vertical movement path, and the door may be rotated around the one end and open the lower end hole of the vertical movement path when the ship balancing means is lowered and moved out of the vertical movement path; and an opening limiting protrusion configured to limit an angle by which the door is opened may be formed on the bottom surface of the lower hull.

According to a preferred feature of the present invention, the ship may further include an upper hull disposed above the lower hull; the upper hull may include: a third buoyancy member configured to be filled with air and maintain a sealed state; and a fourth buoyancy member formed below the third buoyancy member, adapted such that an air injection unit is formed to extend to a cabin part, and configured to generate buoyancy in an emergency in such a manner that air is injected through the air injection unit by means of an air injection device and thus the fourth buoyancy member is inflated; and, when the fourth buoyancy member is inflated, a horizontal surface located below the fourth buoyancy member may be moved downward to a predetermined distance in order to expand a buoyancy space.

According to a preferred feature of the present invention, posts may be formed along the periphery of the top surface of the deck of the lower hull at predetermined intervals, and oars each including a loom and a blade portion may be mounted on the posts in horizontal directions; the upper portion of the loom of each of the oars may be rotatably fastened to one of the posts, and the lower portion of the loom of the oar may be detachably coupled to another post adjacent to the post; and a space may be formed inside the loom, a plurality of water injection holes configured to make the inside and the outside communicate with each other may be formed in the center portion of the loom, and a water discharge hole configured to discharge water may be formed in the lower portion of the loom.

Advantageous Effects

According to the present invention, the following effects can be achieved:

First, in an emergency situation that may be caused by load or loss of buoyancy attributable to flooding, the ship can continuously maintain the state of floating on the water in such a manner that the buoyancy means generate buoyancy inside and below the lower hull, and the ship balancing means can prevent the ship from being tilted to one side or being completely capsized, thereby achieving the effects of preventing a deadly accident that may occur in an emergency, such as a ship sinking accident, and also facilitating rescue operations.

Second, the third and fourth buoyancy members installed in the upper hull are inflated, and thus the buoyancy of the upper hull can be further increased, thereby providing the effect of more safely protecting passengers present in the cabin part.

Third, the plurality of oars are mounted on the lower hull, and thus the hull can be moved by pulling the oars in the early stage of an emergency and the ship can be balanced by the weighty oars in a situation in which the hull is being capsized in such a manner that water enters into the oars through the water injection holes, thereby providing the effect of delaying a case where the hull is tilted in one direction and then capsized.

BEST MODE

Preferred embodiments of the present invention will be described in greater detail below with reference to the accompanying drawings. Prior to the description of the present invention, it should be noted that the following specific structural and functional descriptions are intended merely to illustrate embodiments based on the concept of the present invention, embodiments based on the concept of the present invention may be practiced in various forms, and embodiments based on the concept of the present invention should not be construed as being limited to the embodiments described in the present specification.

Figure 1:
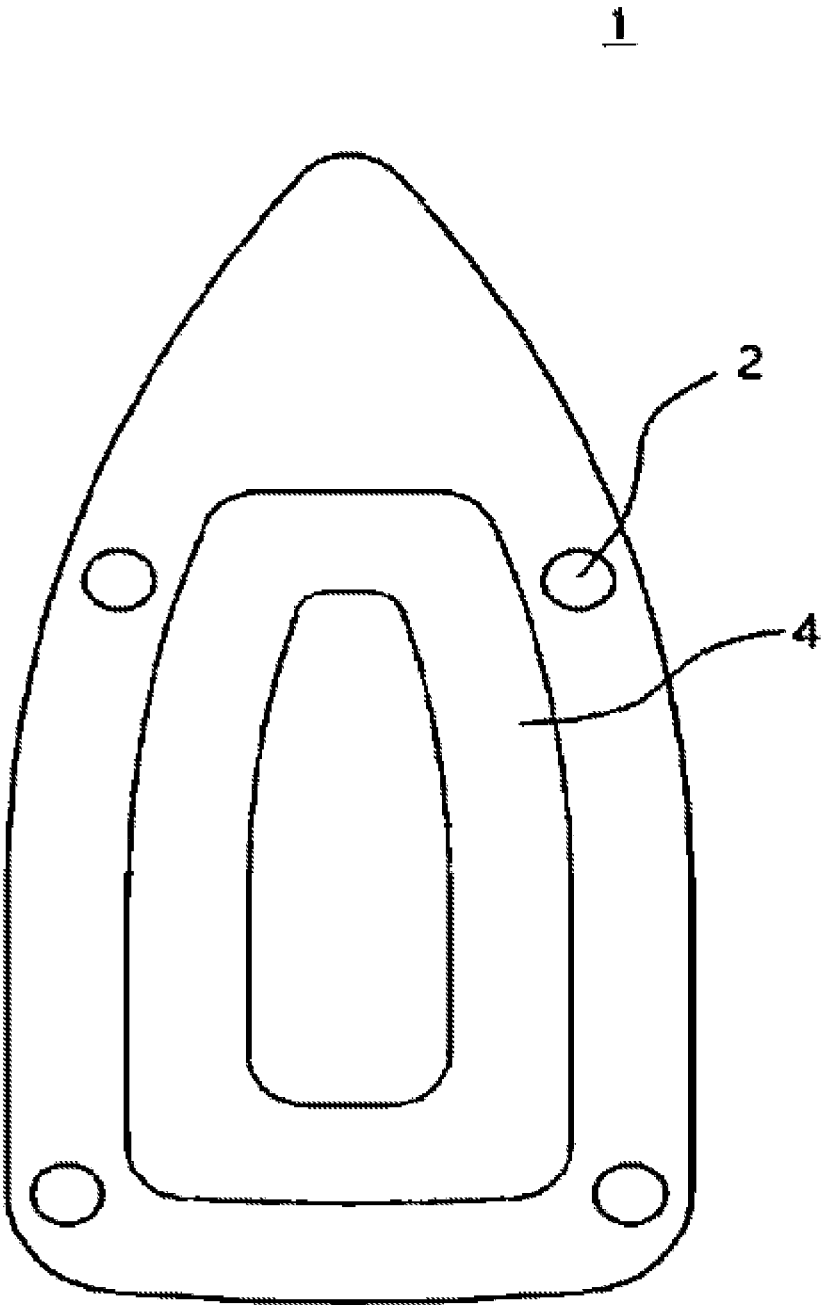
FIG. 1 is a plan view schematically showing a ship according to the present invention.
Figure 2:
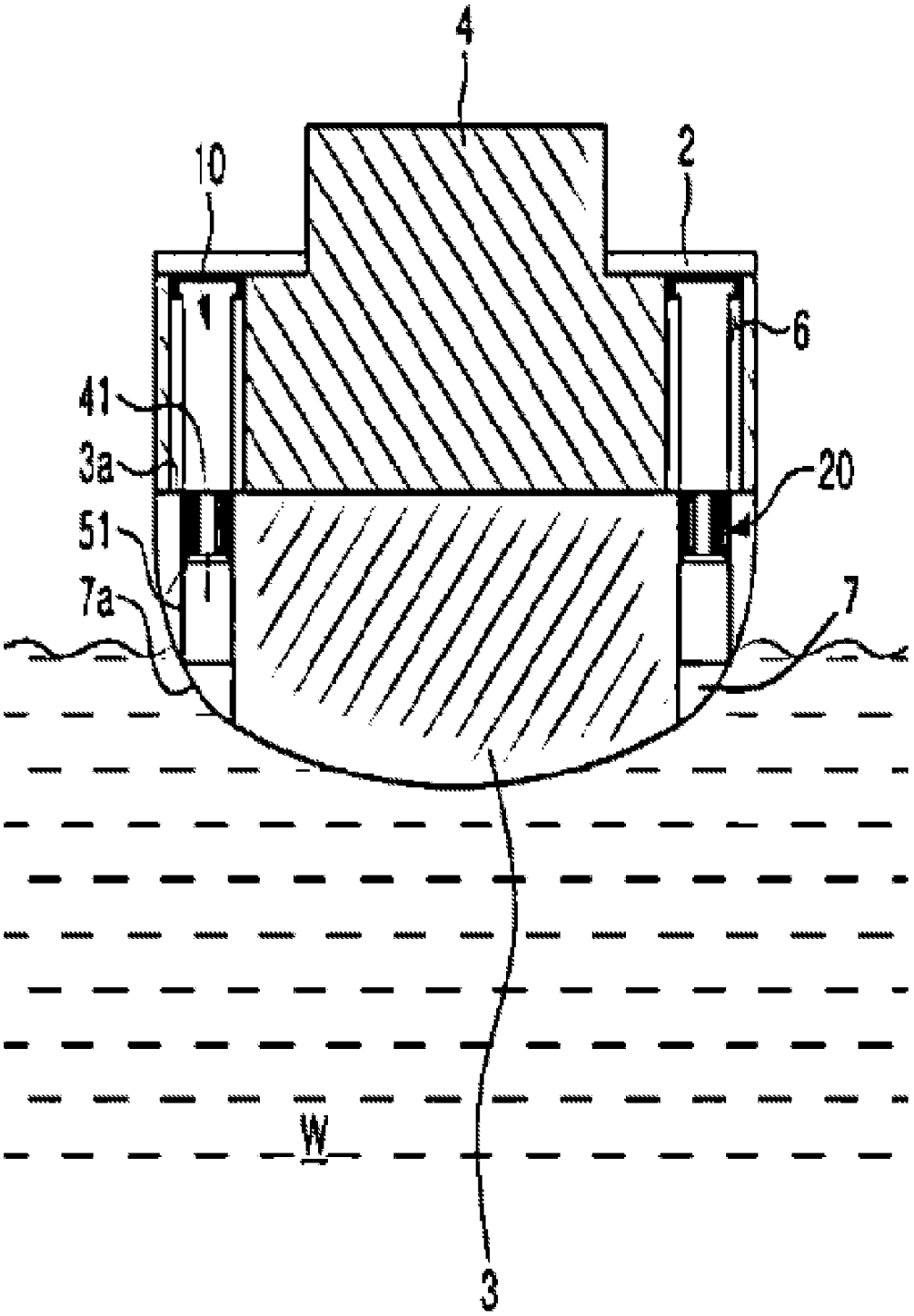
FIG. 2 is a sectional view showing the section of the ship according to the present invention.
Figure 3:
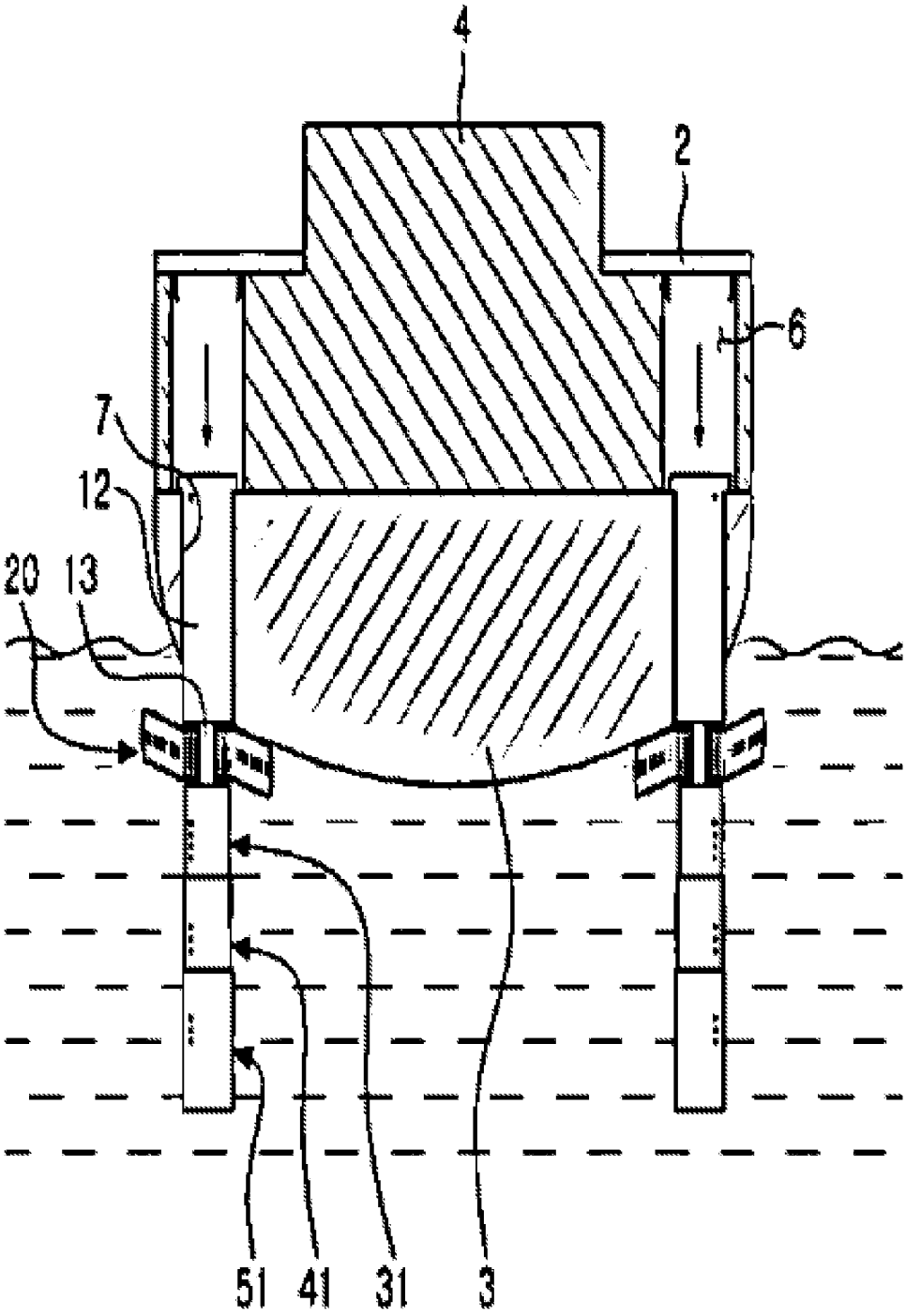
FIG. 3 is a sectional view showing the section of the ship after an anti-sinking and anti-capsize device has operated in FIG. 2.

Referring to FIGS. 1 to 3, a ship 1 having an anti-sinking and anti-capsize device for emergency according to the present embodiment may be basically divided into an upper hull 4 and a lower hull 3.

The upper hull 4 may include a cabin part (not shown) therein. A plurality of installation bars 2 is installed at respective corners on both sides in a distributed manner. The reason why the installation bars 2 are installed along the periphery of the ship 1 is to prevent the center of gravity of the ship or buoyancy from being concentrated on one side and thus prevent the ship 1 from being tilted when anti-sinking and anti-capsize devices operate. In this case, each of the installation bars 2 may provide a space portion 6, where each of the anti-sinking and anti-capsize devices is normally located, between walls below the installation bar 2 in such a manner that the walls are installed beside the upper hull 4.

Meanwhile, according to the present invention, depending on the size of the ship, for example, when a ship, such as a small-sized fishing boat, a sailboat, or the like, does not have an upper hull corresponding to a cover but includes only a lower hull, the installation bars are not installed on the upper hull of the ship, but may be installed to be located at a predetermined height away from the lower hull via vertical support posts, for example, in the form of an inverted and reversed "L." In this case, the vertical support posts for the installation bars may be formed at locations away from the edges of the lower hull to the insides of the deck, or may be installed along the periphery of the lower hull. When the vertical support posts are formed along the periphery of the lower hull, the vertical movement paths of the anti-sinking and anti-capsize devices each having a movement path, which will be described later, need to be provided along the periphery of the lower portion of the lower hull. It will be apparent that although the following description will be given with a focus on a large-sized vessel, the description will be appropriately changed depending on the size of the ship.

The lower hull 3 according to the present embodiment includes vertical movement paths 7 each having a lower end hole 7*a* configured to communicate with the water. In this case, the vertical movement paths 7 are formed at locations, which communicate with the space portions 6, below the installation bars 2.

Each of the anti-sinking and anti-capsize devices according to the present embodiment is normally locked and fastened below the installation bar 2 of the upper hull 4. When the locking is released in an emergency, the anti-sinking and anti-capsize device is lowered to the lower hull 3 along the vertical movement path 7 formed in the lower hull 3, deploys a buoyancy means for preventing the sinking of a ship inside and below the lower hull 3, and extends a ship balancing means for preventing the capsize of a ship long below the lower hull 3, thereby preventing the sinking and capsize of the ship in case of an emergency accident.

Figure 4:
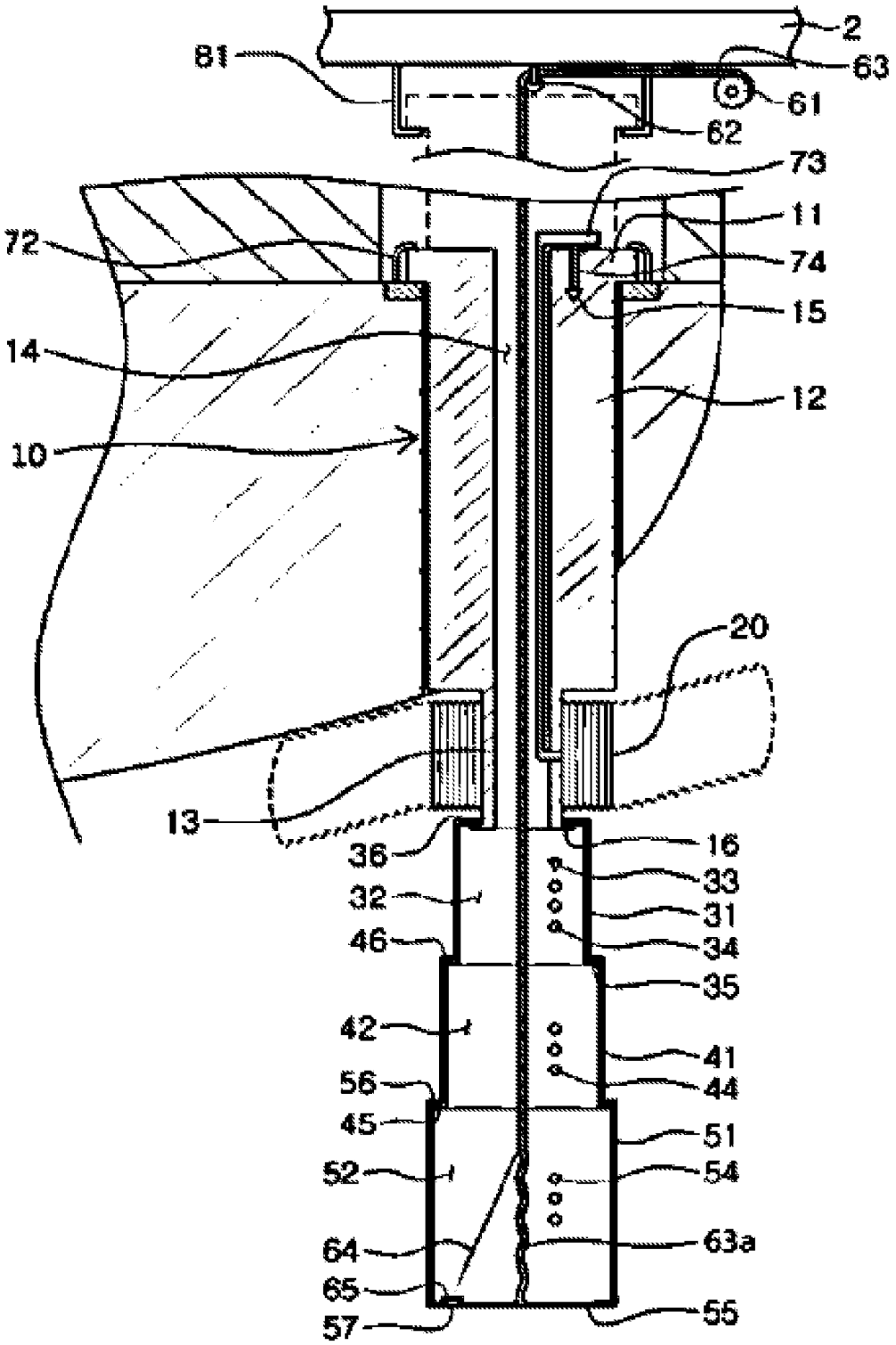
FIG. 4 is an enlarged sectional view showing the important portions of FIG. 3.

Referring to FIG. 4, the buoyancy means includes a first buoyancy member 10 and a second buoyancy member 20. The first buoyancy member 10 includes an upper vacuum cylinder 12 and a lower vacuum cylinder 13. A flange portion 11 is formed at the upper end of the upper vacuum cylinder 12. Normally, the first buoyancy member 10 is locked below the installation bar 2 of the upper hull 4 in the state in which the flange portion 11 has been placed thereon, and is disposed inside the space portion 6 of the upper hull 4. Thereafter, in an emergency, the flange portion 11 of the upper vacuum cylinder 12 is caught and supported on the upper end of the lower hull 3 while the first buoyancy member 10 is moving downward, and the first buoyancy member 10 is located within the vertical movement path 7 of the lower hull 3. In this case, a catch hook 72 may be provided at an upper end of the lower hull 3, and may surround and securely fasten the flange portion 11 supported on the lower hull 3.

The lower vacuum cylinder 13 has a smaller diameter than the upper vacuum cylinder 12, and the second buoyancy member 20 is installed on the circumferential surface of the lower vacuum cylinder 13. The second buoyancy member 20 is formed in the same tubular shape as an air bag. Normally, the second buoyancy member 20 is installed on the circumferential surface of the lower vacuum cylinder 13 in a folded state. When air is injected into the second buoyancy member 20 via an air injection device 73 and thus the second buoyancy member 20 is inflated in an emergency, the second buoyancy member 20 enters the state of having come into close contact with the bottom surface of the lower hull 3. When the emergency is over, air may be discharged from the second buoyancy member 20 by means of the air injection device 73, and the second buoyancy member 20 may be folded back to its original shape. Reference symbol 74 designates a device that is used to selectively inject air into the first buoyancy member 10 and discharge air from the first buoyancy member 10 when necessary.

In other words, the first and second buoyancy members 10 and 20 are disposed inside and below the lower hull 3, respectively, and provide a predetermined level of buoyancy to the ship 1 in an emergency, thereby preventing the ship from sinking even when some degree of flooding occurs.

Figure 5:
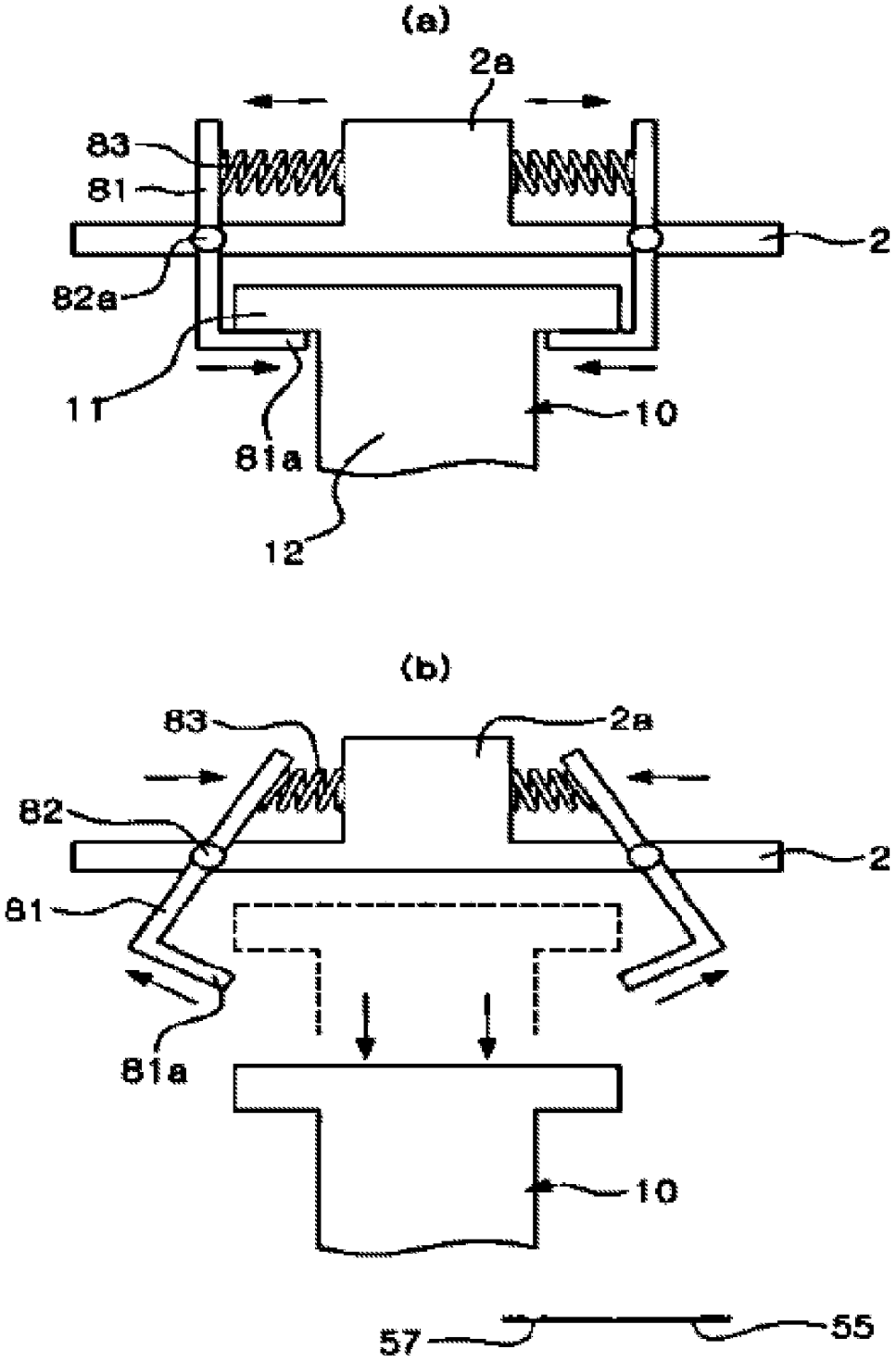
FIGS. 5(*a*) and 5(*b*) are views showing a structure in which an installation bar and a first buoyancy member are coupled to and separated from each other in FIG. 2.

Referring to FIGS. 5(*a*) and 5(*b*), first and second rotating members 81 are tiltably disposed on each of the installation bars 2 of the upper hull 4 at a predetermined interval. First and second support portions 81*a* that are bent inward are formed at the lower ends of the first and second rotating members 81 so that the flange portion 11 of the upper vacuum cylinder 12 can be placed and supported on the first and second support portions 81*a*. Referring to FIG. 5(*a*), the upper portions of the first and second rotating members 81 are elastically supported by fastening portions 82*a* and springs 83, and are normally maintained in the state in which the first and second support portions 81*a* have been closed. Accordingly, the flange portion 11 of the upper vacuum cylinder 12 of the first buoyancy member 10 is placed on the first and second support portions 81*a*, and thus the buoyancy means is located at a location corresponding to that of the upper hull 4.

Referring to FIG. 5(*b*), in an emergency, the first and second support portions 81*a* of the first and second rotating members 81 are operated to spread. Accordingly, the above-described locking is released, and thus the first buoyancy member 10 of the buoyancy means moves down to the lower hull 3 along the vertical movement path 7. The release of the locking may be automatically performed by the operation of a sensor configured to detect an impact on or the flooding of the ship, or may be manually performed by the operation of any one of a crewperson and passengers. In response to the operation, the left and right springs 83 are pulled by a pulling element (not shown) installed in a locking body 2*a*, and thus the first and second rotating members 81 are spread to the left and right, with the result that locking is released.

Referring back to FIG. 4, the ship balancing means extends downward in an antenna form in the state in which the upper end of the ship balancing means has been supported on the lower end of the lower vacuum cylinder 13 in an emergency. The ship balancing means may include a single body or two or more bodies depending on the size of the ship, such as a sailboat, a large vessel, or the like. In the present embodiment, the ship balancing means is shown and described as including first to third bodies 31, 41 and 51.

The first body 31 is configured such that a first stop protrusion 36 is formed at the upper end thereof so that a protrusion 16 formed at the lower end of the lower vacuum cylinder 13 can be caught and supported on the first stop protrusion 36 and such that the lower end thereof is formed in an open shape and a first flange 35 is formed around the lower end. A first fastening protrusion 33 configured to come into close contact with the inner circumferential surface of the second body 41 and temporarily fasten the second body 41 by means of frictional force is formed on the outer circumferential surface of the first body 31 in order to prevent the second body 41, which normally surrounds the outer circumferential surface of the first body 31, from unexpectedly extending downward. Furthermore, one or more first water inlets 34 are formed on the outer circumferential surface of the first body 31.

The second body 41 is configured such that a second stop protrusion 46 is formed at the upper end thereof so that the first flange 35 can be caught and supported on the second stop protrusion 46 and such that the lower end thereof is formed in an open shape and a second flange 45 is formed around the lower end. Furthermore, one or more second water inlets 44 are formed on the outer circumferential surface of the second body 41.

The third body 51 is configured such that a third stop protrusion 56 is formed on the upper end thereof so that the second flange 45 can be caught and supported on the third stop protrusion 56 and such that a support plate 55 is provided on the bottom surface thereof. In this case, the support plate 55 may be separably screwed to the lower end of the third body 51 in order to facilitate the installation of a body collapsing wire to be described later. Furthermore, one or more third water inlets 54 are formed on the outer circumferential surface of the third body 51. In this case, a water outlet 57 is formed in the support plate 55, and the water outlet 57 is generally in the state of having been blocked by a plug 65.

Figure 6:
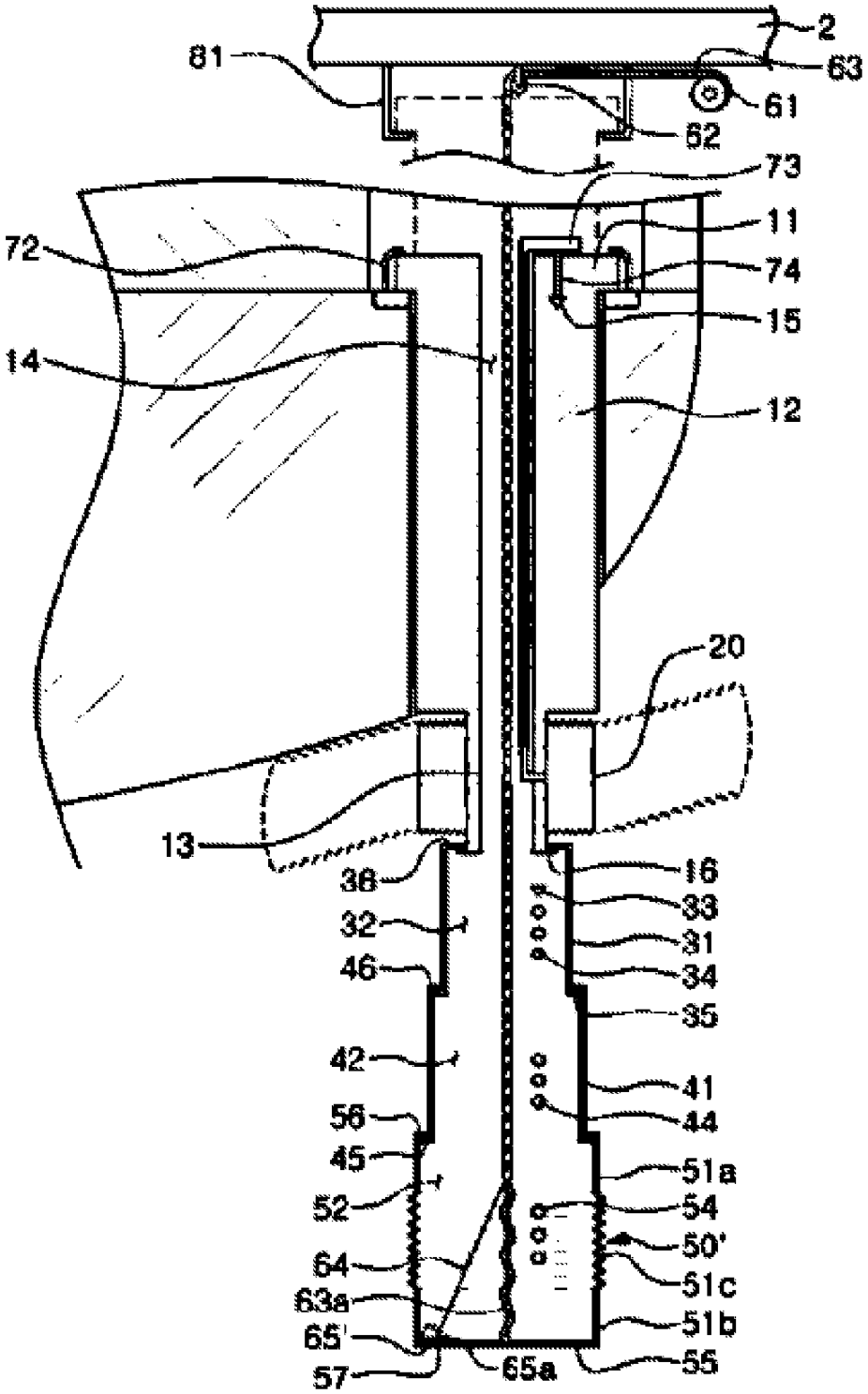
FIG. 6 is a sectional view showing another embodiment of an anti-sinking and anti-capsize device according to the present invention.

Meanwhile, referring to FIG. 6, a part of the circumferential surface of the third body 50 may be formed in a corrugated cylinder shape in order to extend maximally to further secure a water accommodation space. For example, a top 51*a* and a bottom 51*b* may be formed in the shape of flat cylinders because the top 51*a* and the bottom 51*b* need to protect the second buoyancy member 20 and the water outlet 57 with the plug 65, and an intermediate portion 51*c* configured to connect the top 51*a* and the bottom 51*b* may be formed in a corrugated shape.

The ship balancing means configured as described above is normally in the state in which the first to third bodies 31, 41 and 51 have been collapsed. When the ship balancing means is extended out of the ship 1 through the vertical movement path 7 in an emergency, the second and third bodies 41 and 51 are extended long in an antenna manner, and have a shape extended long downward. Furthermore, water enters the inside through the first to third water inlets 34, 44 and 54 formed in the first to third bodies 31, 41, 51, and thus the first to third bodies 31, 41 and 51 are filled with water. Accordingly, the first to third bodies 31, 41 and 51 function as support pillars that prevents a phenomenon in which a ship is tilted to one side or is considerably rocked laterally in a storm or a strong wave and a capsize phenomenon in which a ship is capsized in a serious case by means of the weight of the water filling the inside.

Furthermore, when the emergency is over, the first to third bodies 31, 41 and 51 are collapsed back to their original form. In this case, when water accommodated in the first to third bodies 31, 41 and 51 is discharged by removing the plug 65 from the water outlet 57 of the third body 51, the first to third bodies 31, 41 and 51 can be more easily collapsed back to their original form.

In order to collapse the first to third bodies 31, 41 and 51 back to their original form after the release of an emergency, the body collapsing wire 63 composed of a rope or steel wire is further included. The body collapsing wire 63 is passed through a through hole 14 formed through the centers of the upper and lower vacuum cylinders 12 and 13 in a vertical direction, the lower end 63*a* of the body collapsing wire 63 is fastened to the support plate 55 of the third body 51, and the upper end of the body collapsing wire 63 is coupled to a winding pulley 61 provided on the installation bar 2 of the upper hull 4. Reference symbol 62 designates a pulley configured to switch the direction of the body collapsing wire 63 to the direction of the winding pulley 62.

Furthermore, a water outlet opening wire configured such that an end thereof is coupled to the plug 65 is further connected to the lower portion of the body collapsing wire 63. When the body collapsing wire 63 is pulled, the water outlet opening wire 64 is also pulled, and thus the plug 65 inserted into the water outlet 57 is removed. Accordingly, the water outlet 57 is opened, and thus the water of the water accommodation portion is discharged to the outside first. Thereafter, the bodies are collapsed. In this case, it is preferred that the water outlet opening wire 64 is allowed to be pulled first when the body collapsing wire 63 is pulled by loosening the lower end 63*a* of the body collapsing wire 63 and tightening the water outlet opening wire 64.

In this case, as shown in FIG. 6, the plug 65 may be configured in a structure in which the plug 65 is coupled to one side of the water outlet 57 via a hinge 65*a* and tilted to its one side, rather than a structure in which the plug is completely removed from the water outlet 57, when necessary.

In an emergency, all the bodies are not lowered below the deck along with the first buoyancy member below the installation bar. Depending on the level of an emergency situation, by gradually adjusting the wire, the lowest third body is lowered first, the second body is then lowered, the first body is lowered into the sea, and the first buoyancy member below the installation bar is lowered in case of a serious situation.

Meanwhile, according to the present invention, depending on the size of the ship, in the case where the ship does not have a cover but includes only a lower hull, like a small-sized fishing boat, sailboat, or the like, the wire a reduced structure may be installed. However, the present invention is not limited thereto.

Figure 7:
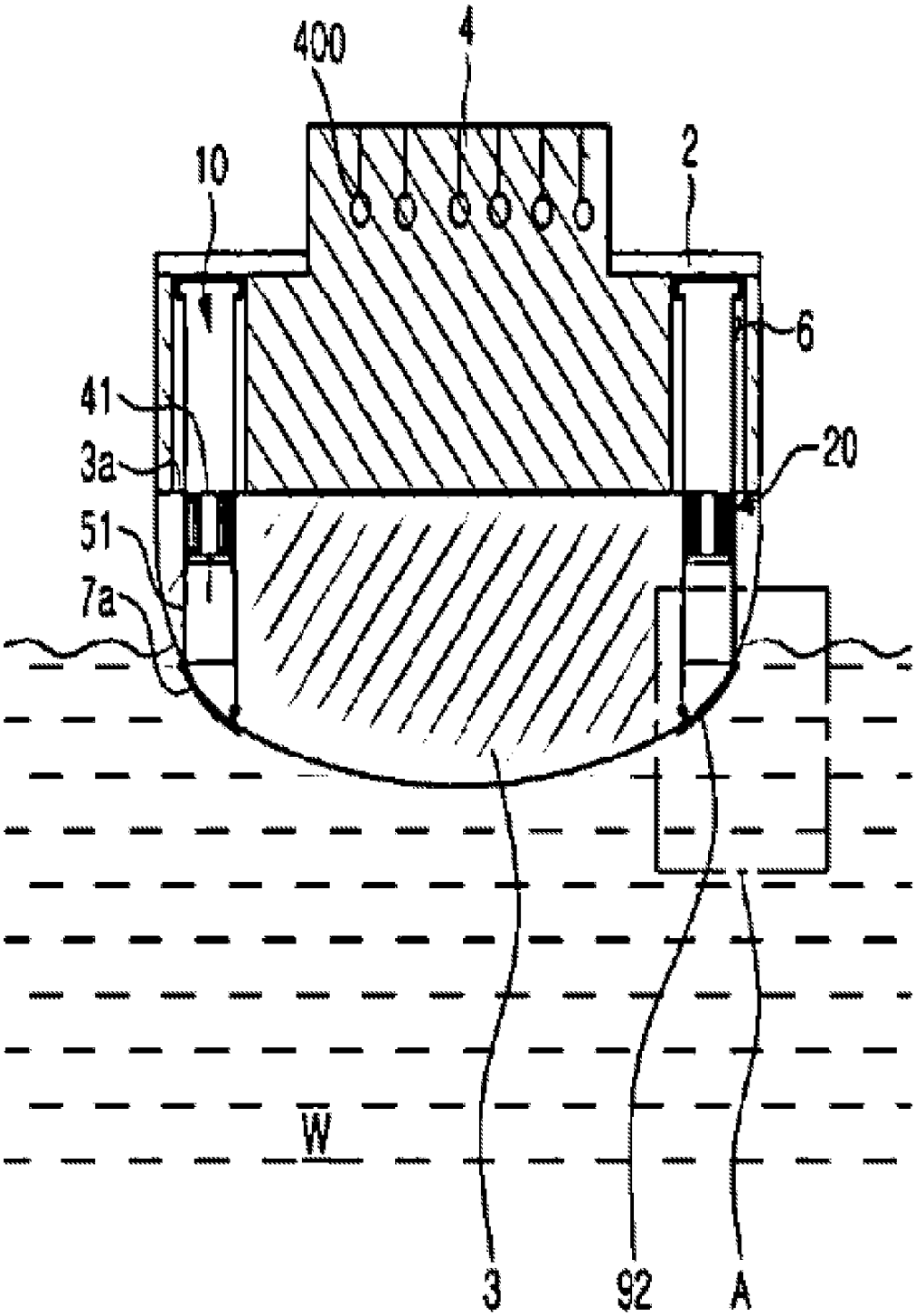
FIG. 7 is a sectional view showing the state in which a door has been further installed in FIG. 2.
Figure 8:
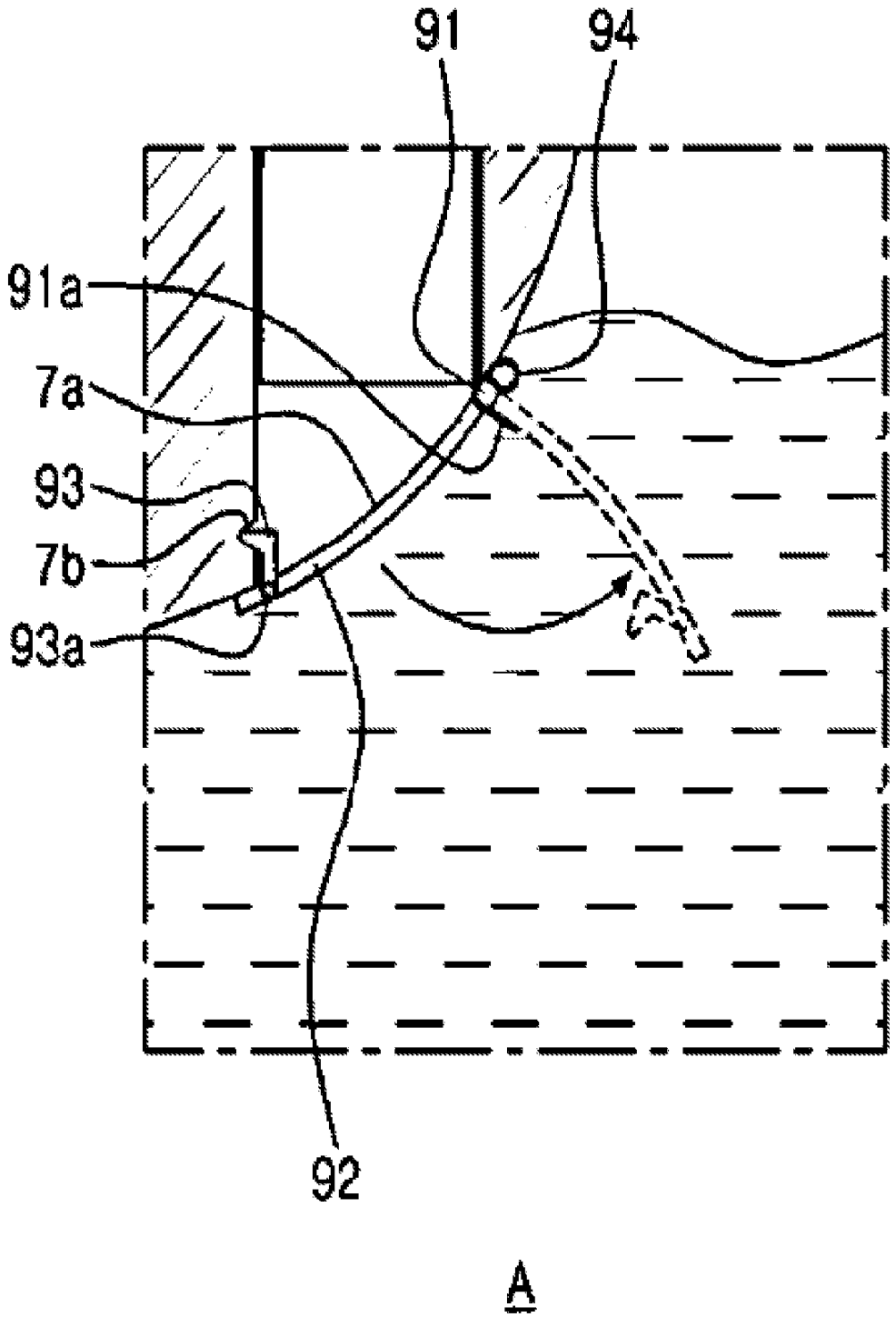
FIG. 8 is an enlarged view of portion A of FIG. 7.
Figure 9:
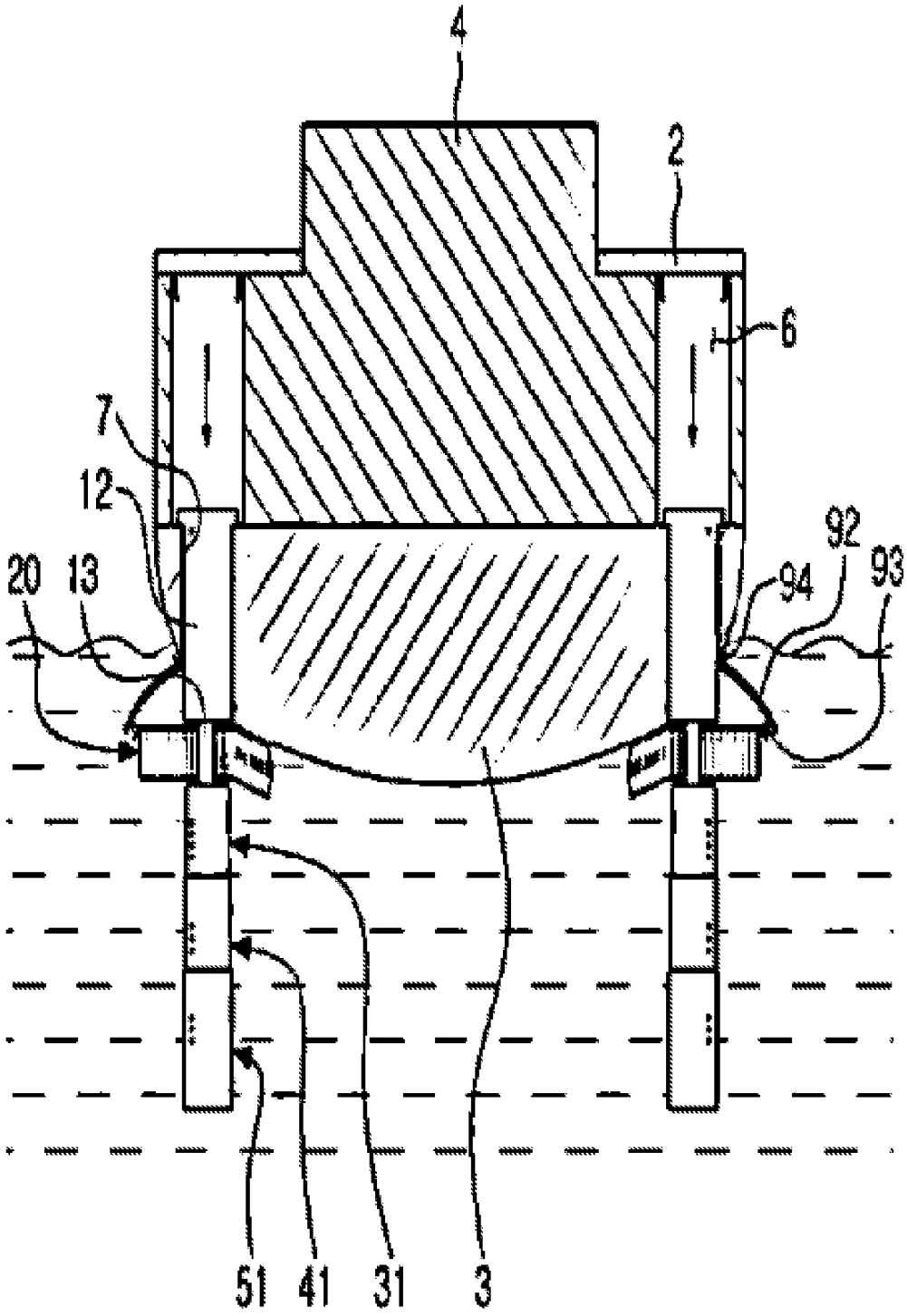
FIG. 9 is a sectional view showing the section of the ship after second buoyancy members have operated in FIG. 7.

Referring to FIGS. 7 to 9, a door 92 may be installed in the lower end hole 7*a* in the vertical movement path 7.

The door 92 is configured such that one end thereof is coupled to the upper end of the hole of the second movement path 7 via a hinge 91 in the state of being elastically supported by a spring 91*a* and a fastening element 93 is coupled to the other end thereof via a hinge 93*a*. The fastening element 93 is fitted into a receiving depression 7*a* formed in the inside of the vertical movement path 7, and temporarily blocks the hole 7*a* of the vertical movement path 7. If the hole of the vertical movement path 7 always remains open, seawater may enter the vertical movement path 7 and causes damage due to waves. The door 92 may eliminate this problem.

Furthermore, when the ship balancing means is lowered and extended out of the second movement path 7, the door 92 opens the hole of the second movement path 7 while being rotated upward around the hinge 91. In this case, an opening limiting protrusion 94 may be formed on the bottom surface of the lower hull 3, and may prevent the door 92 from being opened to an excessive angle. Furthermore, the door 92 opened as described above functions to prevent the second buoyancy member 20 from being excessively lifted upward while protecting the second buoyancy member 20 by supporting the upper end portion of the spread second buoyancy member 20.

Figure 10:
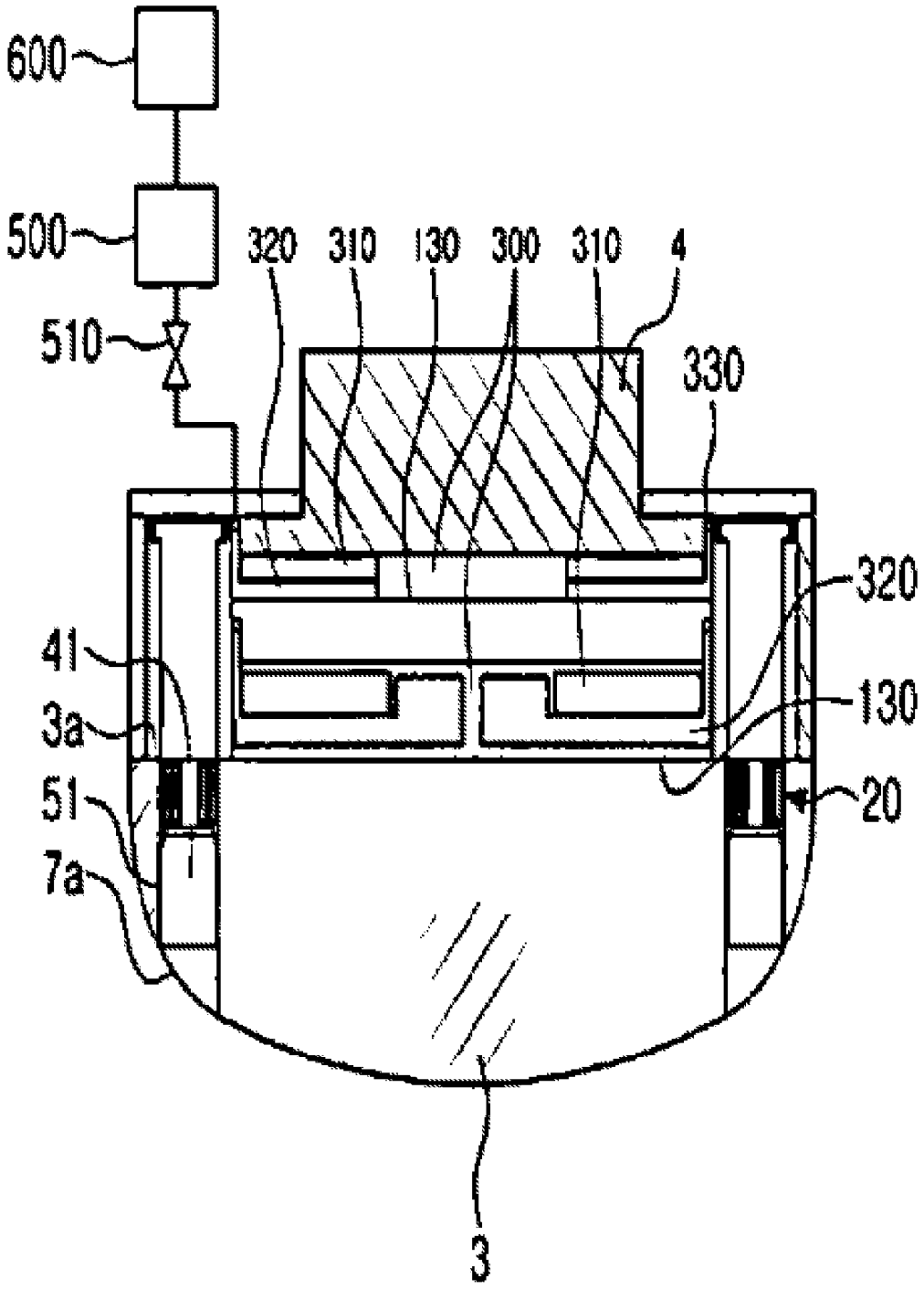
FIG. 10 is a sectional view showing another embodiment of a ship according to the present invention.

Referring to FIG. 10, the ship 1 according to the present invention enables buoyancy to be generated in the cabin part of the upper hull 4, thereby providing a predetermined amount of buoyancy to the upper hull 4 even in an emergency situation, such as sinking accident, and also enabling the buoyancy of the overall ship 1 to be maintained until the ship 1 exceeds a predetermined weight.

The cabin part may include a plurality of cabins for each layer, and may include a single layer or a plurality of layers. A plurality of separate buoyancy spaces 300 may be formed below respective layers of the cabin part.

In this case, the buoyancy space 300 may be provided below the bottom of each cabin of the cabin part, and the buoyancy spaces 300 may include pluralities of third buoyancy members 310 and fourth buoyancy members 320.

The third buoyancy member 310 may be formed in the shape of a box, and may be located in the state of being fastened in the upper portion of the buoyancy space 300 while maintaining the state in which the third buoyancy member 310 has been filled with air and sealed. The state in which the third buoyancy member 310 is fastened in the upper portion of the buoyancy space 300 may be various, and is not limited to a specific state.

Furthermore, one or more third buoyancy members 310 may be disposed in both sides of the buoyancy space in order to maintain the balance of the cabin part. The third buoyancy members 310 may be made of material the surface of which has a predetermined strength or more so that air filling the third buoyancy members 310 can be prevented from leaking to the outside, and may be made of lightweight material.

Therefore, when an emergency situation occurs, the buoyancy of the overall ship 1 may be more stably maintained by the buoyancy of the plurality of third buoyancy members 310 and fourth buoyancy members 320 provided below the cabin part until the ship exceeds a predetermined weight.

Furthermore, the fourth buoyancy members 320 may be made of the material of rubber boat or typical tube, and may be formed in corrugated shapes. However, the fourth buoyancy members 320 are not limited thereto.

An air injection unit 330 configured to inject air may be connected to each of the plurality of fourth buoyancy members 320. The air injection unit 330 may be formed in a shape that extends from the buoyancy space 300 into the inside space of the cabin part.

In other words, the fourth buoyancy members 320 may be formed below a corresponding one of the third buoyancy members 310, the air injection unit 330 may be formed to extend into the inside of a cabin, and the fourth buoyancy members 320 may be inflated and generate buoyancy by injecting air through the air injection unit 330 by means of an air injection device 500 in an emergency. In this case, the air injection device 500 and the air injection unit 330 may be in a connected state, a valve 510 may be provided between the air injection device 500 and the air injection unit 330, and the valve 510 may be opened and air may be injected at the same time that an emergency situation is detected. In this case, the air injection device 500 may be composed of any one of a bicycle pump, a compressor, and a pressure pumping device used for manual blood pressure measuring equipment.

In this case, the fourth buoyancy members 320 may be disposed to be distributed in both sides below the cabin part in the same manner as the third buoyancy members 310 in order to maintain the balance of the upper hull 4. As a result, even when any one of the buoyancy members is damaged, a buoyancy function may be maintained.

Furthermore, the air injection unit 330 may extend along the buoyancy space 300 and both sides of the inner wall surfaces of the cabin part.

Furthermore, the third buoyancy member 310 may come into contact with the air injection unit 330, and may be spaced apart from both sidewall surfaces of the buoyancy space 300 by a predetermined distance.

In this case, the buoyancy space 300 formed below a first layer cabin is a part that comes into contact with a water surface and maintains the buoyancy of the upper hull 4 in an emergency. This buoyancy space 300 may be formed to be larger than the buoyancy space 300 formed below a second or higher layer cabin.

Furthermore, it is preferred that the third buoyancy member 310 and the fourth buoyancy member 320 are also formed to be larger than the third buoyancy member 310 and the fourth buoyancy member 320 formed below a second or higher layer cabin. However, the third buoyancy member 310 and the fourth buoyancy member 320 are not limited thereto.

Additionally, in order to enable the buoyancy space 300 formed below the cabin to be expanded when the fourth buoyancy member 320 is inflated, a horizontal surface 130 located below the fourth buoyancy member 320 may be ruptured or moved downward to a predetermined distance.

When the horizontal surface 130 is configured to be ruptured, the horizontal surface may be made of lightweight material in order to secure the safety of passengers located within the cabin. Furthermore, when the horizontal surface 130 is configured to be moved downward, the horizontal surface may be normally coupled to rails (not shown) fastened to a wall surface and moved downward along the rails in an emergency situation in response to a signal from a control unit. However, the horizontal surface 130 is not limited thereto.

The horizontal surface 130 functions not only to expand the buoyancy space 300 while moving downward, but also to always support the fourth buoyancy member 320 upward before and after the fourth buoyancy member 320 is filled with air.

In this case, the horizontal surface 130 of the buoyancy space 300 located below the first layer cabin may be configured to be moved downward by the inflation of the fourth buoyancy member 320. The horizontal surface 130 may be spaced apart from the fourth buoyancy member 320 by a predetermined distance in order to secure a space in which the fourth buoyancy member 320 can be inflated. However, the horizontal surface 130 is not limited thereto.

Furthermore, the buoyancy space 300 formed below the second layer cabin is formed between the bottom surface of the second layer cabin and the ceiling surface of the first layer cabin. When the fourth buoyancy member 320 is inflated, the horizontal surface corresponding to the ceiling surface of the first layer cabin may be moved downward or ruptured.

As, in an emergency, the fourth buoyancy member 320 is inflated and the horizontal surface 130 corresponding to the ceiling surface of the lower layer is moved downward or ruptured, a vertical space within the cabin located in the lower layer may be configured to be narrowed in an emergency.

This configuration may be also applied to the second layer cabin, the third layer cabin, the fourth layer cabin, and a higher lower cabin in the same manner. The reason why the buoyancy member is provided in each of the cabins is to prevent the ship 1 from capsizing or sinking.

In the ship 1 according to the present invention, which is configured as described above, when an accident occurs during operation, the ship 1 encounters the risk of sinking and the inside of the lower hull 3 is flooded, the buoyancy of the overall ship may be maintained by a predetermined amount of air filling the third buoyancy member 310 or the third buoyancy member 310 and the fourth buoyancy member 320 until the weight of the ship exceeds a predetermined level.

Furthermore, when the air injection device 500 injects air through the air injection units 330, the air is injected into the fourth buoyancy member 320 located below the third buoyancy member 310, the fourth buoyancy member 320 is inflated, and buoyancy may be maintained so that the upper hull 4 can float safely on a water surface.

Figure 11:
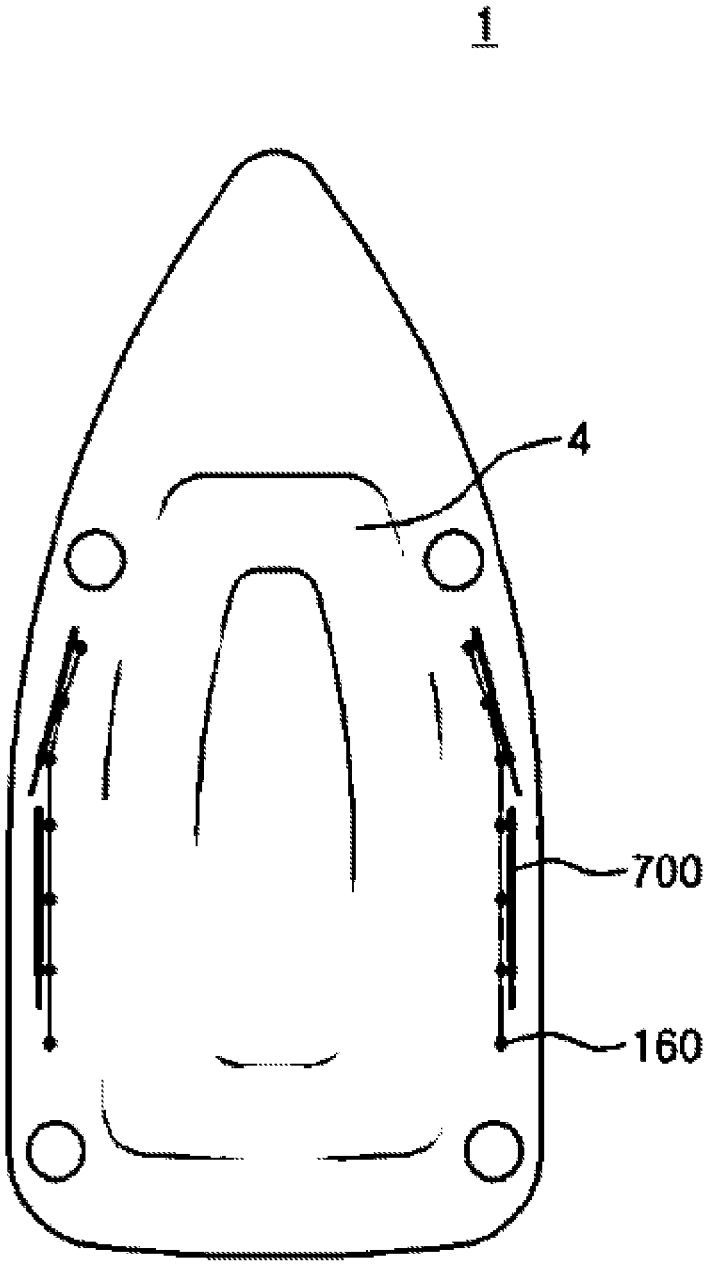
FIG. 11 is a plan view showing another embodiment of a ship according to the present invention in the state in which oars have been mounted on the ship.
Figure 12:
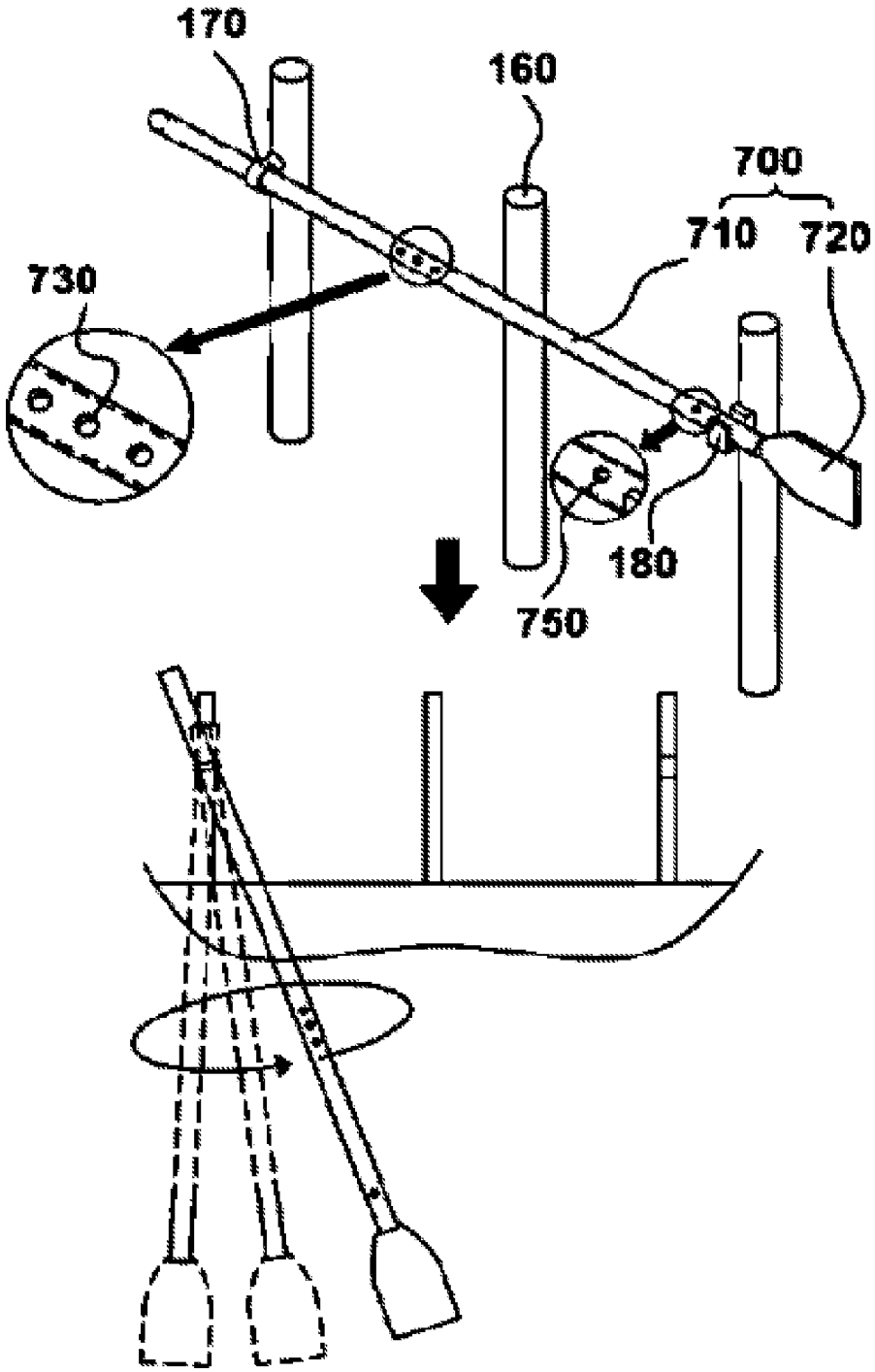
FIG. 12 is an enlarged perspective view showing the oar of FIG. 11.
Figure 13:
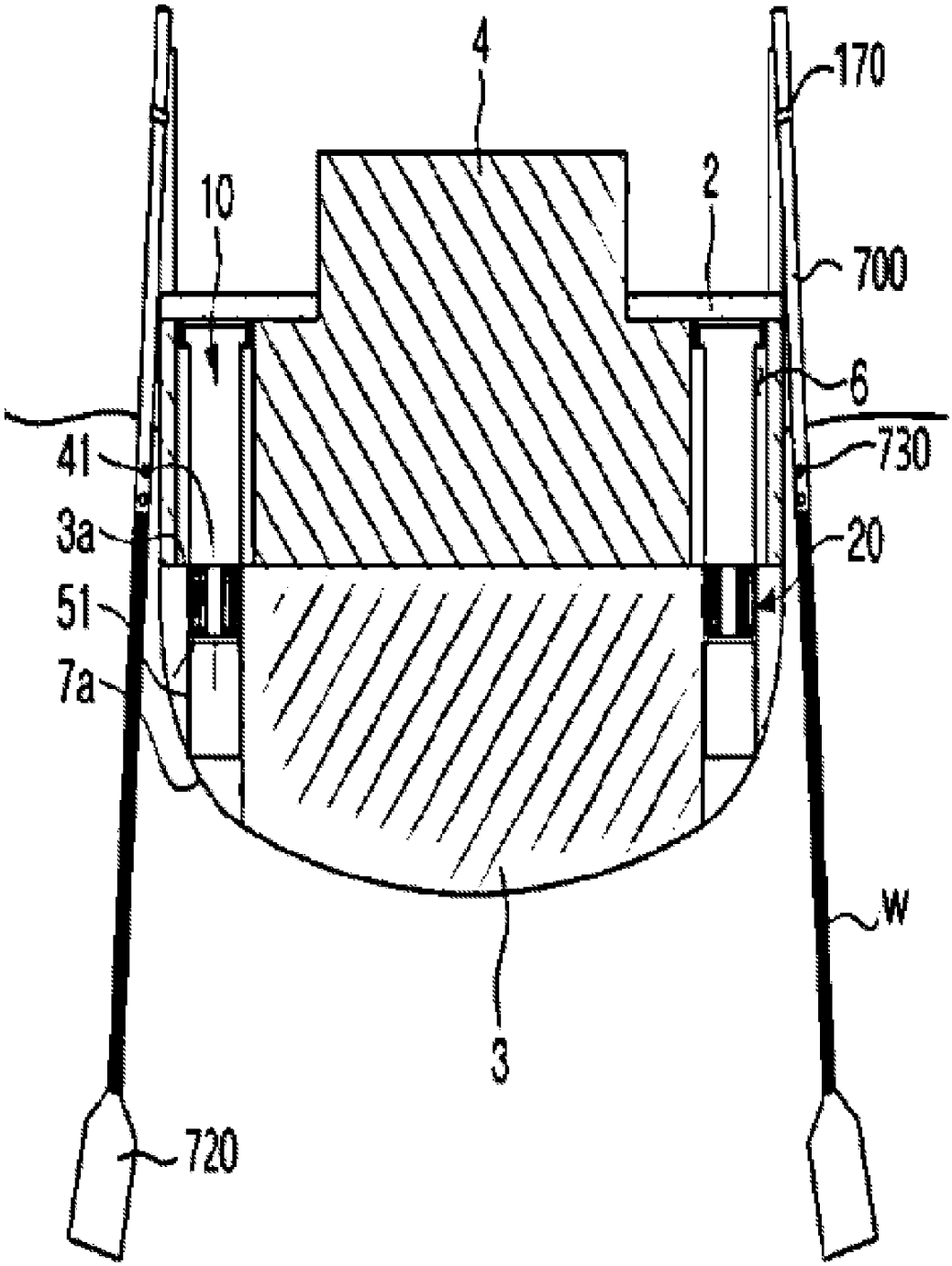
FIG. 13 is a sectional view showing the ship in the state in which the oar of FIG. 11 has been mounted on the ship.

Furthermore, as shown in FIGS. 11 to 13, posts 160 may be formed on a deck, located on the circumference of the outside of the cabin part in the upper hull 4, along the circumference of the top of the deck at predetermined intervals. Oars 700 each including a loom 710 and a blade portion 720 may be mounted on the posts 160 in horizontal directions.

The upper portion of the loom 710, i.e., one side of the loom 710 of each of the oars 700, may be fixedly coupled by a rotatably fastening portion 170 provided on one post 160, and the lower portion of the loom 710, i.e., the other side of the loom 710 of the oar 700, may be detachably coupled to another post 160 adjacent to the post 160 by a detachably fastening portion 180.

Furthermore, the loom 710 of the oar 700 may be formed in a cylindrical shape in which a space is formed. A plurality of water injection holes 730 configured to make the inside and the outside communicate with each other is formed in the center portion of the loom 710, and a water discharge hole 750 configured to discharge water is formed in the lower portion of the loom 710.

As the oars 700 are mounted on the posts 160, the oars 700 are separated from the detachably fastening portions 180 and pulled in an emergency situation, and thus assistance may be provided so that the ship 1 can be moved smoothly.

Furthermore, as shown in FIG. 13, when the ship is seriously tilted and a part of the upper hull 4 sinks, water W enters into the looms 710 of the oars 700 through the water injection holes 730. As the water enters, the blade portions 720 are moved downward by the weight of the water, and thus the oars 700 may remain erected.

In this case, a predetermined amount of water is discharged through the water discharge hole 750 formed in the loom 710 of each of the oars 700, thereby enabling water to continuously enter through the water injection holes 730. Furthermore, the oars 700 may maintain predetermined weights due to the water having entered into the inside spaces thereof, and thus enable the upper hull 4 to remain balanced, thereby preventing the upper hull 4 from being capsized in one direction or sinking.

Meanwhile, as shown in FIG. 7, hanging chair connection rings 400 may be additionally installed on the ceiling of the upper hull 4. These hanging chair connection rings 400 are the same as wires connected to the ceiling. Equipment configured to enable a person to sit or lie down thereon, such as chairs, may be attached to the hanging chair connection rings 400. Accordingly, even when the hull vibrates in an emergency, chairs coupled to the hanging chair connection rings 400 may maximally remain horizontal according to the same principle as a swing, and thus an effect is achieved in that persons sitting on the chairs can maintain their balances very easily.

Since embodiments based on the concept of the present invention may be subject to various modifications and may have various shapes, specific embodiments are illustrated in the drawings and described in the present specification in detail. However, it should be understood that this is not intended to limit the embodiments based on the concept of the present invention to the specific embodiments and all alterations, equivalents and substitutions included in the spirit and technical range of the present invention are included.

DESCRIPTION OF REFERENCE SYMBOLS

1: ship
2: installation bar
3: lower hull
4: upper hull
6: space portion
7: vertical movement path
10: first buoyancy member
11: flange portion
12: upper vacuum cylinder
13: lower vacuum cylinder
20: second buoyancy member
31: first body
41: second body
51: third body
34, 44, 54: water injection hole
57: water outlet
61: winding pulley
62: pulley
63: body collapsing wire
**63*a***: water outlet opening wire
65, 65': plug
73: air injection device
81: rotating member
92: door
310, 320: third and fourth buoyancy member
400: hanging chair connection ring device
700: oar

The invention claimed is:

1. A ship having an anti-sinking and anti-capsize device for emergency, wherein:

a buoyancy means configured to be locked to an installation bar installed on a top of the ship and to, when the locking is released in an emergency, be lowered along a vertical movement path formed in the lower hull and prevent the ship from sinking is disposed inside and below a lower hull, and a ship balancing means configured prevent the ship from capsizing is disposed to extend long below the lower hull;

the buoyancy means comprises: a first buoyancy member including an upper vacuum cylinder configured to have a flange portion at an upper end thereof so that it is normally locked to the installation bar and is caught on and supported by an upper end of the lower hull in an emergency, and a lower vacuum cylinder formed to have a diameter smaller than that of the upper vacuum cylinder; and a second buoyancy member installed around the lower vacuum cylinder in a folded state, and configured to be inflated and disposed on a bottom surface of the lower hull in an emergency; and the ship balancing means comprises: one or more bodies configured to extend while spreading downward in an antenna manner in a state in which an upper end thereof has been supported at a lower end of the lower vacuum cylinder; one or more water inlets formed in the bodies; and a support plate formed at a lower end of the lowest body, and provided with a water outlet having a plug.

2. The ship of claim 1, further comprising: first and second rotating members tiltably installed on the installation bar at a predetermined interval, and configured such that lower ends thereof are bent inward to support the flange portion and form first and second support portions; and springs configured to elastically support upper portions of the first and second rotating members; and further comprising: a body collapsing wire installed such that it is passed through centers of the upper and lower vacuum cylinders in a vertical direction, a lower end thereof is fastened to a support plate of the lowest body, and an upper end thereof is coupled to a winding pulley provided on the installation bar; and a water outlet opening wire installed on a lower portion of the body collapsing wire to be connected to the plug for the water outlet.

3. The ship of claim 1, wherein:

the lowest body is configured such that a part of a circumferential surface thereof is formed in a corrugated cylinder shape;

a door configured to be installed in an lower end hole of the vertical movement path is further included, the door is installed in such a manner that one end thereof is hinged to an upper end of the lower end hole in a state of being elastically supported and a remaining end thereof is fitted into a receiving depression formed in an inside of the vertical movement path, and the door is rotated around the one end and opens the lower end hole of the vertical movement path when the ship balancing means is lowered and moved out of the vertical movement path; and an opening limiting protrusion configured to limit an angle by which the door is opened is formed on a bottom surface of the lower hull.

4. The ship of claim 1, further comprising an upper hull disposed above the lower hull;

wherein the upper hull comprises: a third buoyancy member configured to be filled with air and maintain a sealed state; and a fourth buoyancy member formed below the third buoyancy member, adapted such that an air injection unit is formed to extend to a cabin part, and configured to generate buoyancy in an emergency in such a manner that air is injected through the air injection unit by means of an air injection device and thus the fourth buoyancy member is inflated; and wherein when the fourth buoyancy member is inflated, a horizontal surface located below the fourth buoyancy member is moved downward to a predetermined distance in order to expand a buoyancy space.

5. The ship of claim 1, wherein:

posts are formed along a periphery of a top surface of a deck of the lower hull at predetermined intervals, and oars each including a loom and a blade portion are mounted on the posts in horizontal directions;

an upper portion of a loom of each of the oars is rotatably fastened to one of the posts, and a lower portion of the loom of the oar is detachably coupled to another post adjacent to the post; and a space is formed inside the loom, a plurality of water injection holes configured to make an inside and an outside communicate with each other is formed in a center portion of the loom, and a water discharge hole configured to discharge water is formed in a lower portion of the loom.

* * * * *